US009021841B2

(12) United States Patent
Kottenstette

(10) Patent No.: US 9,021,841 B2
(45) Date of Patent: May 5, 2015

(54) VESSEL LOCKING SYSTEM

(75) Inventor: Christopher J. Kottenstette, Albuquerque, NM (US)

(73) Assignee: Abuse Tech, LLC, Albuquerque, NM (US)

( * ) Notice: Subject to any disclaimer, the term of this patent is extended or adjusted under 35 U.S.C. 154(b) by 486 days.

(21) Appl. No.: 13/391,106

(22) PCT Filed: Aug. 18, 2010

(86) PCT No.: PCT/US2010/002287

§ 371 (c)(1),
(2), (4) Date: Feb. 17, 2012

(87) PCT Pub. No.: WO2011/022065

PCT Pub. Date: Feb. 24, 2011

(65) Prior Publication Data

US 2012/0151975 A1 Jun. 21, 2012

Related U.S. Application Data

(60) Provisional application No. 61/274,584, filed on Aug. 19, 2009.

(51) Int. Cl.
*B65D 55/14* (2006.01)
*E05B 47/00* (2006.01)

(52) U.S. Cl.
CPC ..... *B65D 55/14* (2013.01); *E05B 47/0045* (2013.01); *E05B 47/004* (2013.01)

(58) Field of Classification Search
CPC ... B65D 55/14; E05B 47/0038; E05B 47/004; E05B 47/0045
USPC ..... 70/158–173, 276, 413; 292/251.5; 220/210, 230
See application file for complete search history.

(56) References Cited

U.S. PATENT DOCUMENTS

| | | | | | |
|---|---|---|---|---|---|
| 1,807,033 | A | * | 5/1931 | Hansen | 70/162 |
| 2,090,302 | A | * | 8/1937 | Montgomery et al. | 439/39 |
| 3,626,961 | A | * | 12/1971 | Quinones | 137/296 |
| 3,744,833 | A | * | 7/1973 | Berducone | 292/251.5 |
| 3,837,525 | A | * | 9/1974 | Kobayashi | 220/326 |
| 3,998,078 | A | | 12/1976 | Detwiler | |
| 4,132,091 | A | * | 1/1979 | Aro et al. | 70/165 |
| 4,223,799 | A | | 9/1980 | Eyster et al. | |
| 4,489,842 | A | | 12/1984 | Bobrove | |
| 4,703,636 | A | * | 11/1987 | Minami | 70/229 |
| 4,796,768 | A | | 1/1989 | Stuckey | |
| 4,848,812 | A | * | 7/1989 | Slaughter | 292/144 |
| 4,984,698 | A | | 1/1991 | Stuckey | |

(Continued)

FOREIGN PATENT DOCUMENTS

WO WO 89/07076 8/1989

OTHER PUBLICATIONS

International Patent Corporation Treaty Patent Application No. PCT/US2010/002287, filed Aug. 18, 2010.

(Continued)

*Primary Examiner* — Lloyd Gall
(74) *Attorney, Agent, or Firm* — Craig R. Miles; CR Miles P.C.

(57) ABSTRACT

A vessel locking system which provides a locking cap which secures in locked engagement with a vessel releasable by mated engagement of a cap key with the locking cap.

18 Claims, 14 Drawing Sheets

(56) References Cited

U.S. PATENT DOCUMENTS

| | | | | |
|---|---|---|---|---|
| 5,188,405 | A * | 2/1993 | Maccaferri | 292/204 |
| 5,405,037 | A | 4/1995 | Piron | |
| 5,431,293 | A | 7/1995 | Piron | |
| 5,485,733 | A * | 1/1996 | Hoffman | 70/276 |
| 6,223,923 | B1 | 5/2001 | Fishman | |
| 8,424,703 | B2 * | 4/2013 | Meulen | 220/230 |

OTHER PUBLICATIONS

U.S. Appl. No. 61/274,584, filed Aug. 19, 2009.

* cited by examiner

VESSEL LOCKING SYSTEM

This application is the United States National Stage of International Patent Cooperation Treaty Application No. PCT/US2010/002287, filed Aug. 18, 2010, which claims the benefit of U.S. Provisional Patent Application No. 61/274,584, filed Aug. 19, 2009, each hereby incorporated by reference herein.

I. TECHNICAL FIELD

A vessel locking system which provides a locking cap which secures in locked engagement with a vessel releasable by mated engagement of a cap key with the locking cap.

II. BACKGROUND

Manufacturers of foodstuffs, beverages, medicaments, dentifrice, volatile solvents, personal property, and the like conventionally package products in containers or vessels having tamper resistant or tamper evident closures or caps to ensure that products contained within the container are not tampered with or that tampering is evident to the consumer.

There are many conventional examples of tamper evident closures. For example, it is common to provide an externally screw threaded neck which receives a closure with a tamper evident band which engages behind a retaining flange formed on the neck of the container. The tamper evident band joins the skirt portion of the closure by a number of frangible bridges. The closure is received by the externally screw threaded neck and the band is forced over the retaining flange. When the closure is subsequently unscrewed from the container the bridges are readily broken as the band is trapped behind the retaining flange while the closure moves up the neck of the container.

Additionally, there are many conventional examples of child proof or tamper proof closures which engage the container by complementary coupling elements. External pressure can be exerted upon the closure to bring the coupling elements out of engagement and upon simultaneous rotation of the locking cap the latter may be brought into an angular position in which respective bores of the closure and the container coincide to allow removal of the closure.

While tamper evident and tamper proof closures have been widely accepted by the market, there remain substantial unresolved problems with these conventional closures.

One substantial problem with conventional tamper evident and tamper proof closure may be that the closure can be removed and reapplied without damaging the frangible bridges or the complimentary coupling elements in order to contaminate or replace the container contents.

Another substantial problem with conventional tamper evident and tamper proof closures may be that manipulation of the closure is sufficiently uncomplicated to allow removal of these closures by most persons and even children.

Another substantial problem with conventional tamper evident and tamper proof closures may be that the container and cap cannot be dedicated for use by a single consumer. Rather, the conventional taper evident and taper proof containers can provide access to any consumer capable of manipulating the closure to open and close the container.

The invention relates to certain apparatuses and methods which address each of the foregoing problems associated with conventional tamper evident and tamper resistant containers.

III. DISCLOSURE OF INVENTION

Accordingly, a broad object of the invention can be to provide a vessel locking system which provides a closure (or cap) and a vessel having complimentary coupling elements which engage and disengage by mated engagement of a discrete key with the cap or the vessel or both.

A second broad object of the invention can be to provide a vessel locking system which provides a closure and vessel essentially incapable of disengagement by manipulation without mated engagement of a discrete key.

Naturally, further objects of the invention are disclosed throughout other areas of the specification, drawings, photographs, and claims.

IV. A BRIEF DESCRIPTION OF THE DRAWINGS

V. MODE(S) FOR CARRYING OUT THE INVENTION

A vessel locking system which provides a locking cap which secures in locked engagement with a vessel releasable by mated engagement of a cap key with the locking cap.

Figure 1:
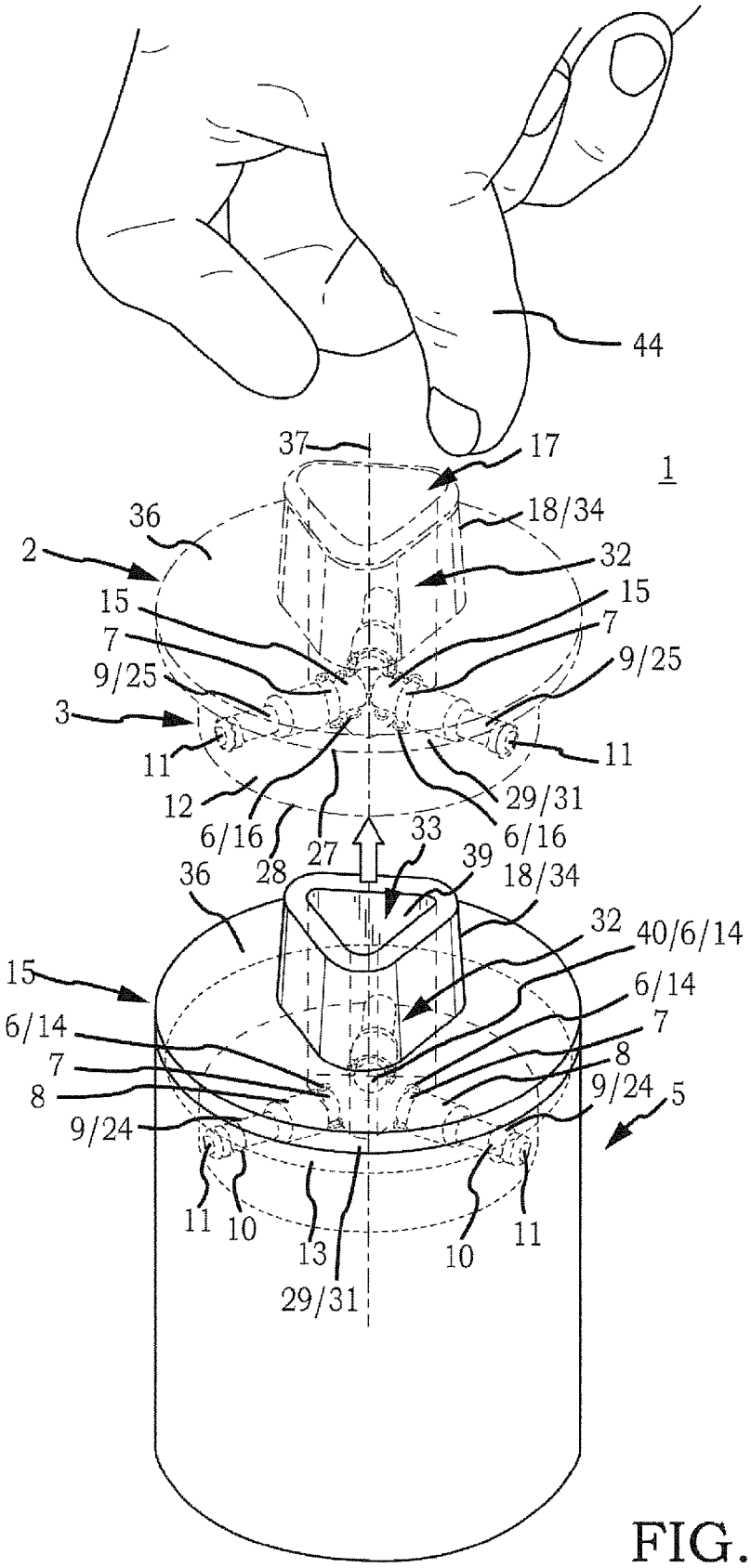
FIG. 1 illustrates a method of using a particular embodiment of the vessel locking system including a particular embodiment of a cap key insertingly received by a locking cap to disengage each of a plurality of locking members from a corresponding plurality of lock member catches to allow removal of the lock cap (removed cap with inserted cap key in broken lines).

Now referring primarily to FIG. 1 which illustrates a non-limiting method of releasably locking a cap in relation to the inlet of a vessel. Particular embodiments of the vessel locking system (1) provide a locking cap (2) having a plug (3) which can be inserted within an inlet (4)(see for example FIGS. 3 and 4) of a vessel (5) (also referred to as a "vessel inlet"). A magnetic field (6) can then be generated proximate the plug (3) of the locking cap (2). The magnetic field (6) can be of sufficient strength to repulse one or more lock member magnets (7) correspondingly coupled to a second end (8) of one or more lock members (9). Each lock member (9) can be slidely engaged within a lock member bore (10). Repulsion of the lock member magnets (7) by the magnetic field (6) can generate sufficient travel of each lock member (9) within the corresponding lock member bore (10) to extend a first end (11) of each lock member (9) beyond a side surface (12) of the plug (3). The first end (11) of each locking member (9) can extend a sufficient distance beyond the side surface (12) of the plug (3) to engage a portion (13)(also referred to as the "vessel catch") of the vessel (5). The locking cap (2) can be retained in locked relation to the inlet (4) of the vessel (5) by engagement of the first end (11) of each lock member (9) with a corresponding portion or vessel catch (13) of the vessel (5).

Figure 5:
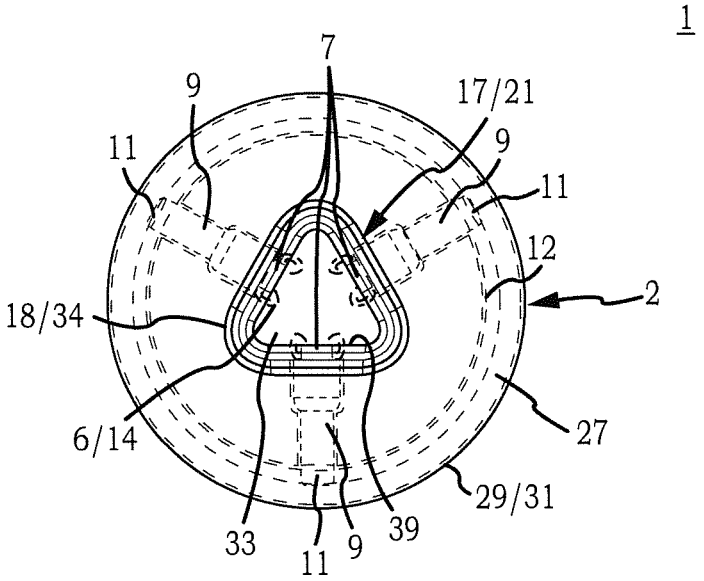
FIG. 5 is a plan view of a particular embodiment of a locking cap which can be fitted to the vessel inlet of the vessel shown in FIGS. 1-3.

Now referring primarily to FIGS. 1 and 5, as to certain embodiments of the vessel locking system (1) the step of generating a magnetic field (6) proximate the plug (3) can be achieved by providing a plurality of locking members (9) slidely engaged with the corresponding lock member bore (10) to dispose the plurality of lock member magnets (7) in repulsed magnetic relation (14)(as shown in the non-limiting example of FIG. 5).

Again referring primarily to FIGS. 1 (broken line) and 8, by locating one or more cap key magnets (15) in attractive magnetic relation (16) to the one or more lock member magnets (7) repulsion by the magnetic field (6) can be overcome and sufficient travel of each lock member (9) can be achieved to disengage the first ends (11) of the lock members (9) from corresponding catches (13) of the vessel (5). The plug (3) of the locking cap (2) can then be removed from the vessel (5).

Figure 8:
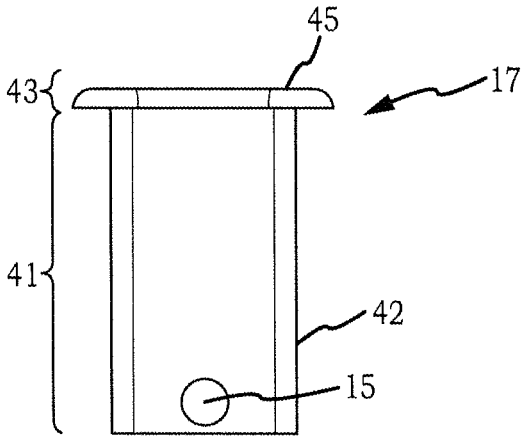
FIG. 8 is a side view of a particular embodiment of a cap key which can be used with the particular embodiment of the locking cap shown in FIGS. 5-6.

Again referring primarily to FIGS. 1 and 8, particular embodiments of the vessel locking system (1), allow guided insertion of a cap key (17) within a cap key guide (18) to dispose the one or more lock member magnets (7) in attractive magnetic relation (16) with one or more cap key magnets (15) coupled to the second end (8) of each locking member (9).

Now referring primarily to FIGS. 11-14, other particular non-limiting embodiments of the vessel locking system (1) allow guided alignment of a cap key (17) to dispose one or more cap key magnets (15) proximate the first end (11) of the locking member (9) to dispose the one or more lock member magnets (7) in repulsed magnet relation (14) to the one or more cap key magnets (15).

With the cap key (17) engaged with the locking cap (2), the plug (3) can be reinserted into the inlet (4) of the vessel (5). Removal of the cap key (17) again disposes the one or more lock member magnets (7) in repulsed magnetic relation (14) to extend the corresponding first ends (11) of the locking members (9) a sufficient distance beyond the side surface (12) of the plug (3) to re-engage the corresponding catches (13) of the vessel (5).

The particular locking caps (2) and methods of releasably locking a locking cap (2) described herein and illustrated by FIGS. 1-16 are not intended to be limiting but rather sufficiently descriptive to allow a person of ordinary skill to use the numerous and wide variety of vessel locking systems (1) encompassed by the invention as claimed.

Figure 2:
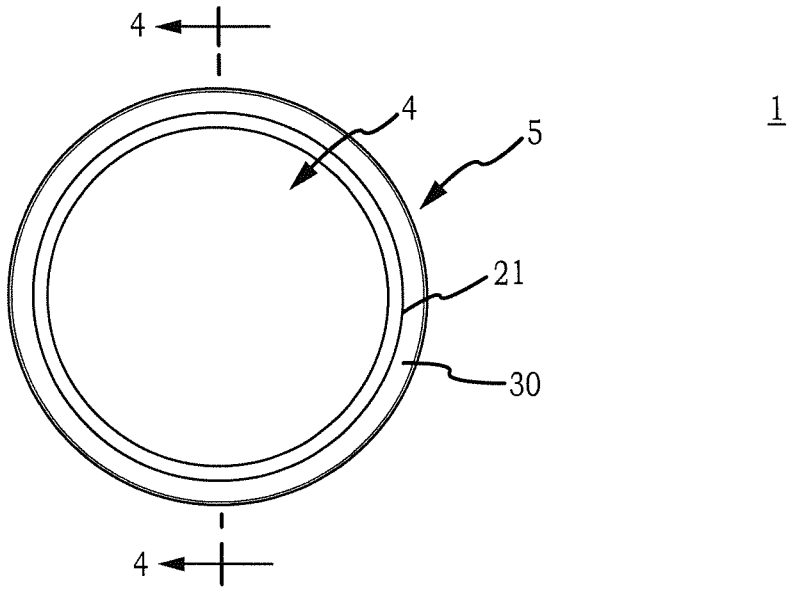
FIG. 2 is a plan view of a particular vessel which can be used in particular embodiments of the vessel locking system.
Figure 3:
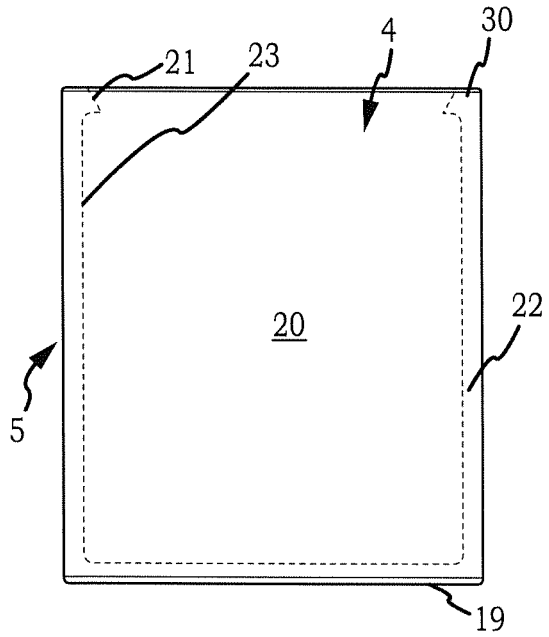
FIG. 3 is a side view of a particular vessel which can be used in an embodiment of the vessel locking system.
Figure 4:
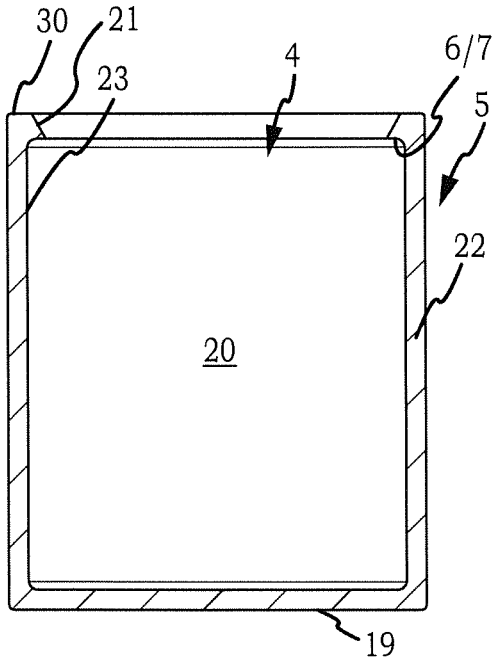
FIG. 4 is cross section 4-4 of the particular vessel shown in FIG. 2.

Now referring primarily to FIGS. 2-16, particular embodiments of the vessel locking system (1) can include a vessel (5) having at a least one vessel inlet (4). As shown in FIGS. 2 and 3, particular embodiments of the vessel (5) can have one closed end (19) and one inlet (4); however, the invention is not so limited and certain embodiments of the vessel (5) can provide a first vessel inlet and a second vessel inlet (or more vessel inlets) depending upon the application; although only one inlet (4) is shown in the Figures. Additionally, while the embodiment of the vessel (5) shown in FIGS. 2-3 has a substantially cylindrical external surface configuration which defines a substantially cylindrical receiving chamber (20); the invention is not so limited and the vessel (5) can have other external surface configurations such as square, rectangular, oval or the like which can but are not obligated to correspondingly define the configuration of the receiving chamber (20).

Embodiments of the vessel (5) can further include a lock member catch (13). Particular embodiments of the lock member catch (13) can take the form of an annular member (21) coupled to the side wall (22) of a cylindrical vessel (5) proximate the vessel inlet (4) to provide a radially inward extending lock member catch (13) as shown for example in FIGS. 1, 3 and 4; however the invention is not so limited, and the lock member catch (13) can have a variety of configurations which engage a corresponding variety of lock member (9) configurations encompassed by embodiments of the vessel locking system (1). As non-limiting examples, the lock member catch (13) can also take the constructional form of an annular channel or periodic recesses cut, formed, or otherwise disposed in the inner vessel surface (23).

Now referring primarily to FIGS. 5-6 and FIGS. 11-12, as above-described, particular embodiments of the vessel locking system (1) can further include at least one locking cap (2) a portion of which removably engages the inlet (4) of the vessel (5) to establish in the alternative the closed condition (24) of the locking cap (2)(as shown in FIG. 1) and the open condition (25)(as shown by broken line in FIG. 1) of the locking cap (2). As shown in FIG. 5, certain embodiments of the locking cap (2) can include a plug (3) configured to be received within the inlet (4) of the vessel (5). The plug (3) can have a height (thickness)(26) disposed between a top surface (27) and a bottom surface (28) and bounded by a side surface (12) configured to be removably inserted a distance into the inlet (4) of the vessel (5) to dispose the side surface (12) in engageable or sealable relation with the inner vessel surface (23) of the vessel (5) and the first end (11) of each lock member (9) in lockable relation with corresponding lock member catches (13); however, the invention is not so limited and the side surface (12) of the plug (3) and the inner vessel surface (23) of the vessel (5)(or lock member catch (13)) can as a non-limiting example be configured to provide spiral threads which rotatingly engage to draw the plug (3) into the vessel inlet (4). While the plugs (3) shown in the non-limiting examples of the Figures are substantially cylindrical; the invention is not so limited and the plug (3) can be configured to be received by a wide and numerous variety of inlets (4) of the vessel (5). Accordingly the configuration of the plug (3) bounded by the side surface (12) can be square, rectangular, oval, or the like.

Again referring primarily to FIGS. 5-6 and FIGS. 11-12, as to certain embodiments of the invention, a cap body (29) can be further coupled to the plug (3) (although certain embodiments may not include a cap body (29)). The cap body (29) can have a configuration of sufficiently greater dimension than the plug (3) to prevent the cap body (29) from being inserted or passing through the inlet (4) of the vessel (5). The cap body (29) can engage the side wall terminal (30) about the inlet (4) of the vessel (5) to fix the location of the plug (3) in relation to the inner vessel surface (23) of the vessel (5)(or the lock member catches (13)). The cap body (29) while shown as a circular disk (31) in FIGS. 5 and 6, does not necessarily have to conform to any particular configuration, so long as the configuration sufficiently engages the side wall terminal (30) to establish the plug (3) in operable relation to the vessel (5). Accordingly, while the plug (3) may be cylindrical in configuration the perimeter of the cap body (29) can be configured to provide a square, rectangle, oval, triangle, hexagonal, or other perimeter configuration.

Now referring to primarily FIGS. 5 and 6 and FIGS. 11 and 12, embodiments of the vessel locking system (1) can further include a cap key guide (18) coupled to the plug (3) or cap body (29). The cap key guide (18) having a configuration which receives a portion of a cap key (17) (see for example FIGS. 7 and 8 and FIGS. 13 and 14). The cap key (17) can be engaged with the cap key guide (18) to operate a cap lock (32).

Figure 6:
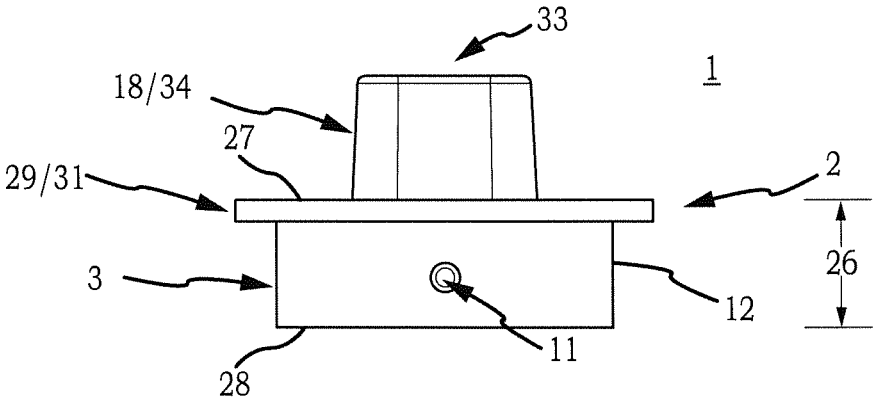
FIG. 6 is side view of the particular embodiment of a locking cap shown in FIG. 5 which can be fitted to the vessel inlet of the vessel shown in FIGS. 1-3.

Now referring primarily to FIGS. 5-6, certain non-limiting embodiments of the cap key guide (18) can have a substantially triangular external surface configuration which can extend upwardly from the cap body (29)(or plug (3)). The cap key guide (18) as shown in FIGS. 5 and 6 further provides a key guide inlet (33) into which the cap key (17) can slidely insert (as above-described and shown in FIG. 1). While the key guide inlet (33) shown by FIG. 5 has a substantially triangular configuration which receives a substantially triangular cap key (17) (as shown for example in FIGS. 7-8); the invention is not so limited and the cap key guide (18) can be have a key guide inlet (33) of any configuration which allows operation of the cap lock (32) with the cap key (17) received by the key guide inlet (33). Additionally, a wide and numerous variety of cap keys (17) and the key guide inlets (33) in various permutations and combinations can provide complimentary engaged elements configured uniquely for each combination of a locking cap (2) and a vessel (5) such as variously configured tab elements each of which uniquely mate with a correspondingly configured slot element, or the like.

Figure 11:
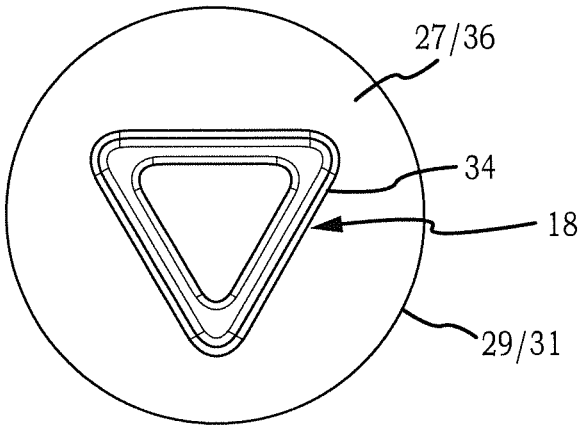
FIG. 11 is a plan view of a particular embodiment of a locking cap which can be fitted to the vessel inlet of the vessel shown in FIGS. 2-4.
Figure 12:
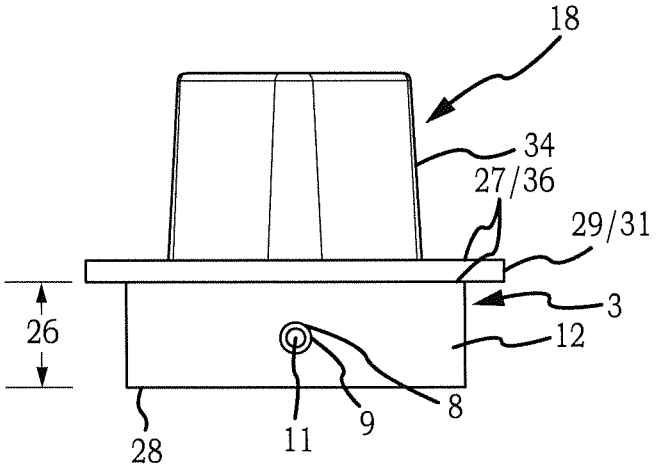
FIG. 12 is side view of the particular embodiment of a locking cap shown in FIG. 4 which can be fitted to the vessel inlet of the vessel shown in FIGS. 2-4.
Figure 13:
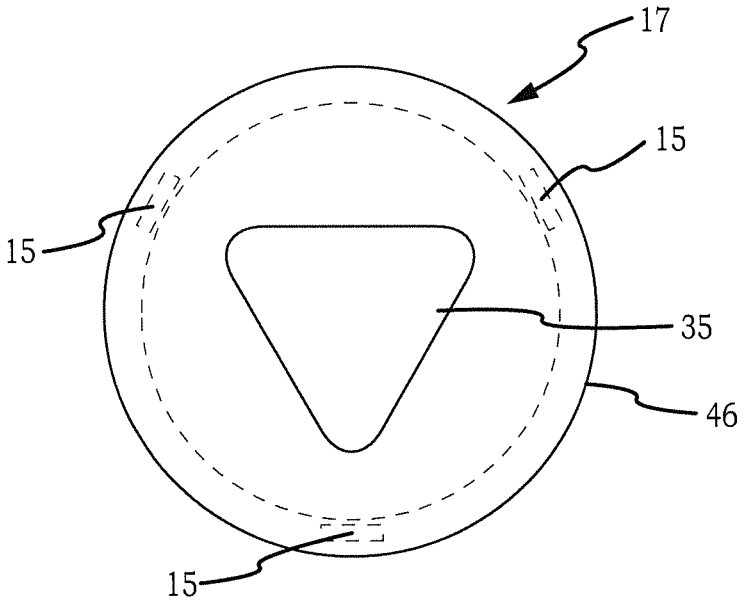
FIG. 13 is a plan view of a particular embodiment of a cap key which can be used with the particular embodiment of the locking cap shown in FIGS. 11-12.

Now referring primarily to FIGS. 11-14, certain non-limiting embodiments of the key guide (18) do not provide a key guide inlet (33), rather, as one example the external surface (34) of the key guide (18) can have a substantially triangular configuration which receives a cap key (17) having a cap key aperture (35) configured to be received about the external surface (34) of the key guide (18). As a non-limiting example, the cap key (17) shown in FIGS. 12-13 provides a cap key aperture (35) having a triangular configuration which can be positioned in relation to the external surface (34) of the key guide (18) to slide downwardly proximate a portion of the cap body surface (36) of the cap body (29). Understandably, embodiments of the cap key aperture (35) and the external surface (34) of the key guide (18) can be configured in various configurations which mate to dispose the cap key (17) in relation to the cap body (29) or plug (3) to operate the cap lock (32).

Figure 7:
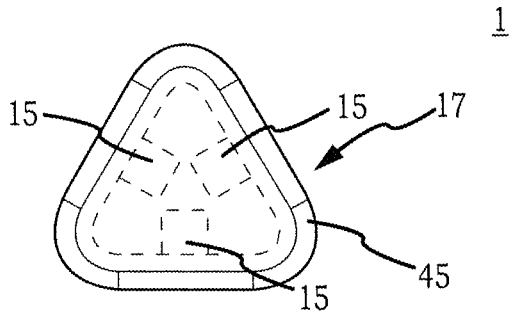
FIG. 7 is a plan view of a particular embodiment of a cap key which can be used with the particular embodiment of the locking cap shown in FIGS. 5-6.
Figure 9:
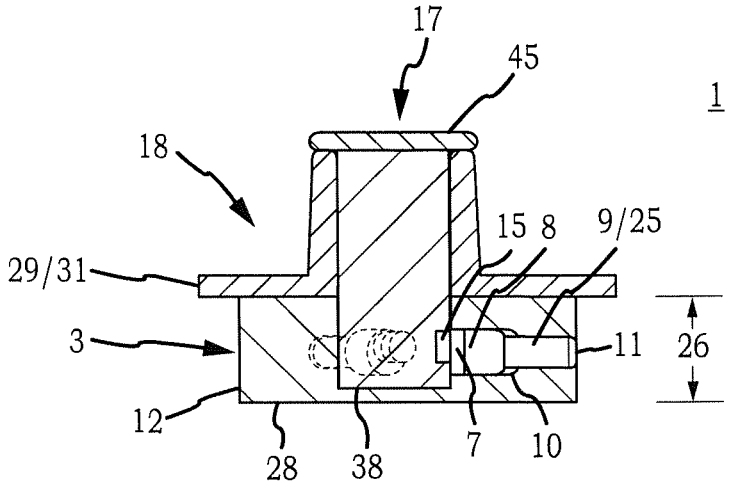
FIG. 9 is a cross section view of the particular locking cap shown in FIGS. 5-6 having a plurality of lock pins each in the retracted condition.
Figure 10:
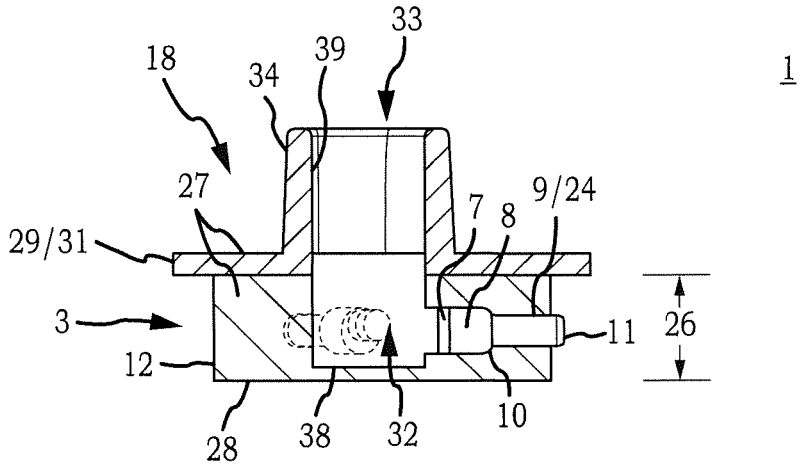
FIG. 10 is a cross section view of the particular locking cap shown in FIGS. 5-6 having a plurality of lock members each in the extended condition.

Now referring primarily to FIGS. 9 and 10, embodiments of the vessel locking system (1) which provide a cap lock (32) operable by embodiments of the cap key (17) (as shown in FIGS. 7 and 8) received within the key guide (18)(as shown for example in FIGS. 1 and 5) can include at least one lock member (9) which travels within a corresponding at least one lock member bore (10) between a open condition (25) of the locking cap (2)(as shown for example in FIG. 9) and an closed condition (24) (as shown in FIG. 10). The at least one lock member bore (10) can extend radially outward proximate the center of the plug (3) to communicate with the side surface (12) of the plug (3). As one non-limiting example, the at least one lock member bore (10) can be disposed to communicate with the side surface (12) at about one half the height (26) of the plug (3) between bottom surface (28) and the top surface (27). The non-limiting embodiment of the cap lock (32) shown in FIGS. 9 and 10 provides three lock member bores (10) each extending radially outward proximate the center of the plug (3) to communicate with the side surface (12) of the plug (3) at about one half the height (26) of the plug (3). The height (26) of the plug (3) and the location of the lock member bores (10) can provided in a variety of configurations each of which allow each of the at least one lock members (9) in the closed condition (24) (extended) to correspondingly engage a catch (13) of the vessel (5). The engagable portions of the at least one lock member (9) and the corresponding at least one catch (13) can be configured in a numerous and wide variety of lockingly matable configurations which sufficiently engage to prevent removal of the plug (3) from the inlet (4) of the vessel (5).

Again referring primarily to FIGS. 9 and 10, the key guide inlet (33) can have a central longitudinal axis (37) which passes through the center of the plug (3) in substantially perpendicular relation to one or more locking member bores (10); although the invention is not so limited. The key guide inlet (33) can have closed guide end (38) located at a depth within the plug (3) sufficient for the internal surface (39) of the key guide inlet (33) to communicate with one or more lock member bores (10) proximate the center of the plug (3).

Figure 15:
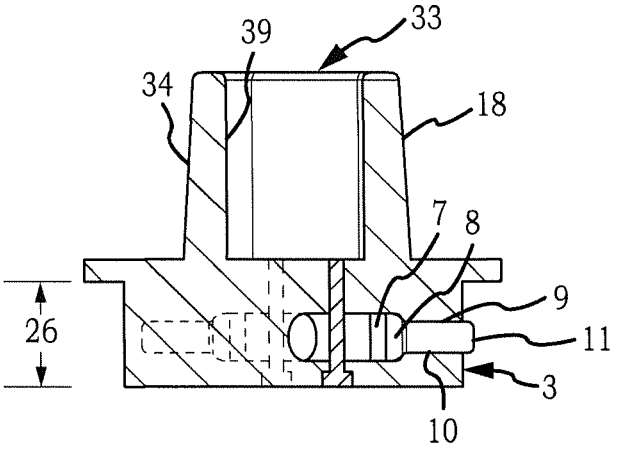
FIG. 15 is a cross section view of the particular locking cap shown in FIGS. 11-12 having a plurality of lock pins each in the extended condition.
Figure 16:
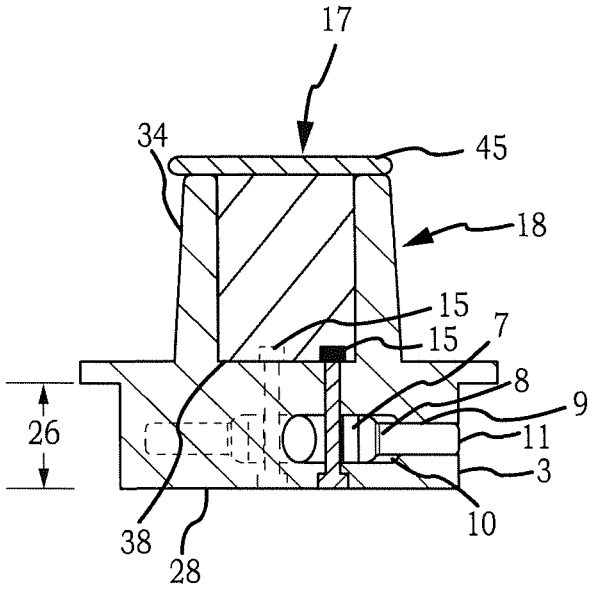
FIG. 16 is a cross section view of the particular locking cap shown in FIGS. 11-12 having a plurality of lock pins each in the retracted condition.

Now referring primarily to FIGS. 15 and 16, as to certain embodiments of the locking cap (2) which releaseably lock by operation of a cap key (17) having a key aperture (35) (as shown in FIG. 13) through which a key guide (18) passes allowing the cap key (17) to locate proximate the cap body surface (36) (or plug), there may be no key guide inlet (33). Accordingly, the radially extending lock member bores (10) may intersect at about the center of the plug (3). Alternately, as shown in FIGS. 15 and 16, a key guide inlet (33) can provide a closed guide end (38) having depth which does not allow the internal surfaces of the cap key inlet (33) to communicate with the lock member bores (10).

Now referring primarily to FIGS. 9 and 10 and 15 and 16, each lock member (9) can have a length disposed between a first end (11) and a second end (8). The lock member (9) can be received within a corresponding lock member bore (10) to dispose the second end (8) proximate the center of the plug (3) and the first end (11) distal the center of the plug (3). The lock member (9) can have sufficient length to locate the first end (11) a distance outward from the side surface (12) of the plug (3) when the lock member (9) is in the closed condition (24) (extended). Each lock member (9) can further include a lock member magnet (7) coupled to or integral with the second end (8) configured to travel with the corresponding lock member (9) in the corresponding lock member bore (10). As to those embodiments of the locking cap (2) having a plurality of lock member bores (10) extending radially outward from the center of the plug (3) each of which receive a corresponding one of a plurality of lock members (9), each second end (8) can include a lock member magnet (7) whether as separate joined pieces or as one integral piece. Like poles of the lock member magnets (7) can be oriented toward the center of the plug (3) such that the lock member magnets (7) are disposed in repulsed magnetic relation (14) (repel one another). The lock member magnets (7) can each have a magnetic moment of sufficient magnitude to repel one another with sufficient force to generate outward travel of each lock member (9) within the corresponding lock member bore (10) a distance outwardly sufficient to engage the first end (11) with a corresponding vessel catch (13) of the vessel (5) when the plug (3) has a location within the inlet (4) of the vessel (5). As to those embodiments which have one lock member (9) the lock member magnet (7) coupled to the first end (11) can be disposed in repulsed magnetic relation (14) to the magnetic field (6) of a second magnet (40) having fixed location within the plug (3)(shown in FIGS. 9 and 10). As to certain embodiments of the lock member (9) and corresponding lock member bore (10) the diameter of the lock member (9) can be greater proximate the second end (8) and lesser diameter proximate the first end (11). The lock member bore (10) can correspondingly be greater proximate the center of the plug (3) and lesser diameter proximate the side surface (12) of the plug (3). As shown in FIG. 9, the greater diameter portion of the lock member (9) can travel in a corresponding portion of the lock member bore (10) having greater diameter and the lesser diameter portion of the lock member (9) can travel in the portion of the lock member bore (10) of lesser diameter. The greater diameter portion of the lock member (9) being of sufficient diameter to obviate travel within the lesser diameter portion of the lock member bore (10) such that the lock member (9) has a fixed location within the lock member bore (10) in the closed condition (24) (extended).

Now referring primarily to FIG. 8 which shows a side view of a non-limiting example of the cap key (17) a part of which inserts within the key guide inlet (33) of the key guide (18) shown in FIGS. 9 and 10. The cap key (17) can have a first end portion (41) configured to insert into the key guide inlet (33). As to the embodiment of the cap key (17) shown in FIG. 8, the first end portion (41) can be substantially triangular in cross section to insert in a key guide inlet (33) also substantially triangular in cross section, although the cross section geometry of the cap key (17) is not so limited. One or more key magnet(s) (15) can have a fixed location on the external surface (42) of the first end portion (41) of the cap key (17) such that when the cap key (17) inserts into the key guide inlet (33) each key magnet (15) aligns in attractive magnetic relation (16) to a corresponding lock member bore (10). Each key magnet (15) when inserted into the key guide inlet (33) can dispose an unlike magnetic pole in relation to the magnetic pole of the lock member magnet (7) having a magnetic moment of sufficient magnitude to generate sufficient travel in the lock member (9) toward the center of the plug (3) to result in the open condition (25)(retracted). Removal of the cap key (17) results in like magnetic poles of the lock member magnets (15) repelling each other to result in the closed condition (24) (extended). A second end portion (43) of the cap key (17) can be configured to be grippable by a cap key user (44). While FIGS. 7 and 8 show the second end portion (43) of the cap key (17) configured to provide a grip element (45) of triangular configuration; the invention is not so limited and the second portion (43) of the cap key (17) grippable by the cap key user (44)(shown in FIG. 1) can be configured in any manner which allows the cap key user (44) to insert and withdraw the cap key (17), whether directly or indirectly, from the key guide inlet (33), such as a sphere, a cube, a rectangular volume, cylinder, or the like.

Figure 14:
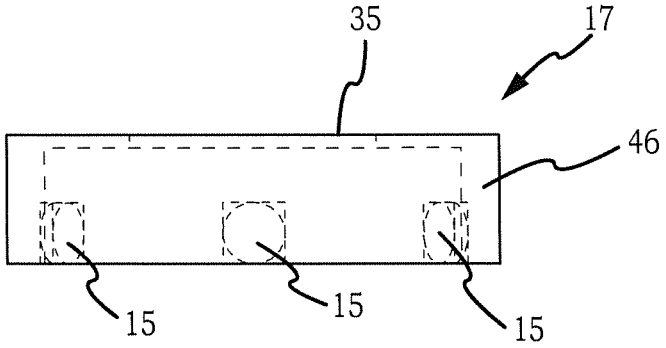
FIG. 14 is a side view of a particular embodiment of a cap key which can be used with the particular embodiment of the locking cap shown in FIGS. 11-12.

Now referring primarily to FIGS. 13 and 14, particular embodiments of a cap key (17) can provide a cap key aperture (35) through which a correspondingly configured embodiment of the cap key guide (18) as shown in FIGS. 11 and 12 can pass to locate the cap key (17) proximate the top surface (27) of the plug (3) or cap body (29). The cap key (17) having the cap key aperture (35) can be a substantially flat sheet as shown; however, the invention is not so limited and other configurations of the cap key (17) can be utilized which allow the cap key (17) to locate proximate the top surface (27) of the plug (3) or cap body (29). The cap key (17) having a cap key aperture (35) can be configured to dispose a cap key rim (46) proximate a portion of the external surface of the vessel (5) when the cap key guide (18) has been inserted through the cap key aperture (35) and the cap key (17) locates in fixed relation to the plug (3) or cap body (29). One or more key magnets (15) can be coupled to the cap key rim (46) in repulsed magnetic relation (14) to the lock member magnets (7) correspondingly coupled to lock members (9). The key magnets (15) can provide sufficient magnetic moment to generate travel of each lock member (9) toward the center of the cap plug (3) to result in the open condition (25) (retracted) of each lock member (9). The open condition (25) of the lock members (9) disengages the lock members (9) from the corresponding vessel catches (13) to allow the locking cap (2) to be removed from the vessel (5).

Figure 22:
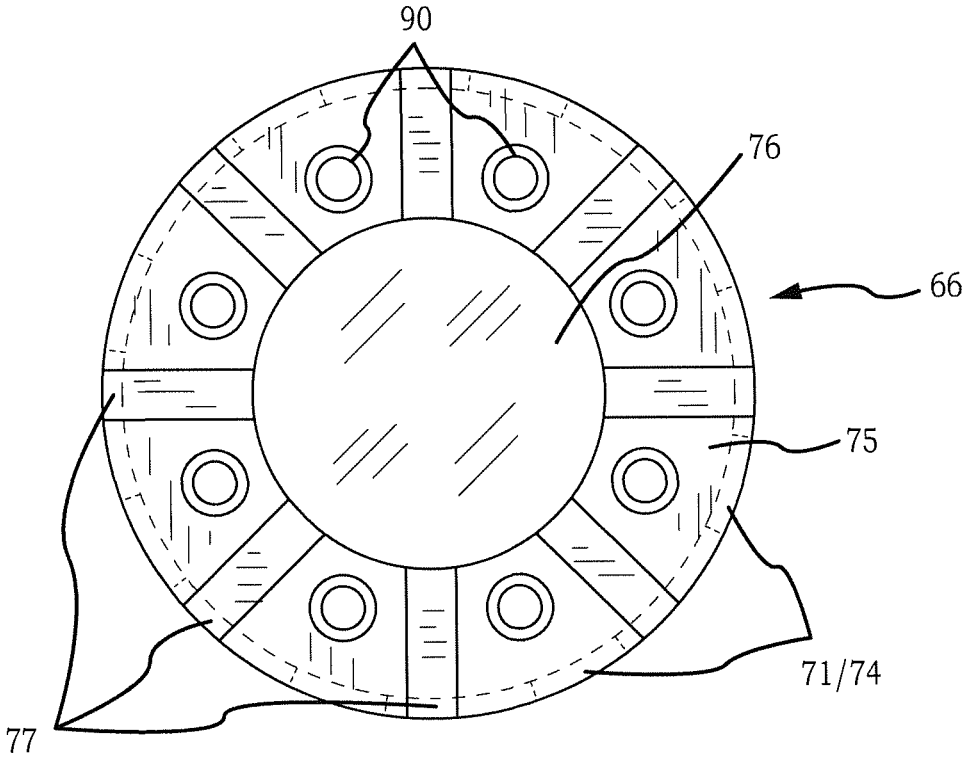
FIG. 22 is a plan view of a particular embodiment of a cam support which can be utilized with the locking cap shown in FIG. 17.
Figure 23:
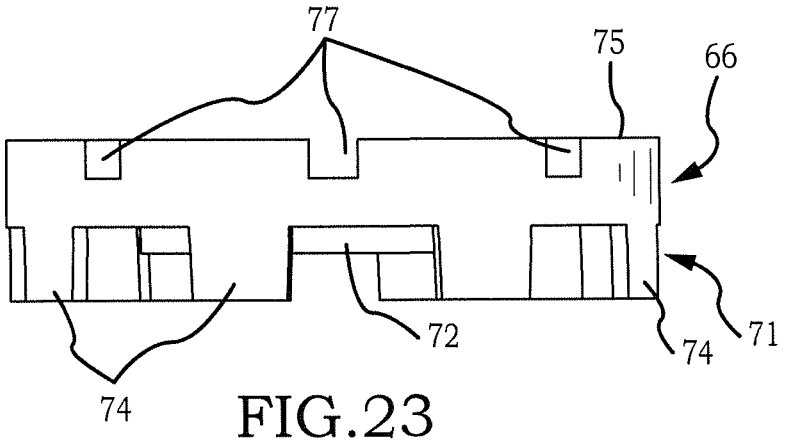
FIG. 23 is a side view of a particular embodiment of a cam support which can be utilized with the locking cap shown in FIG. 17.
Figure 24:
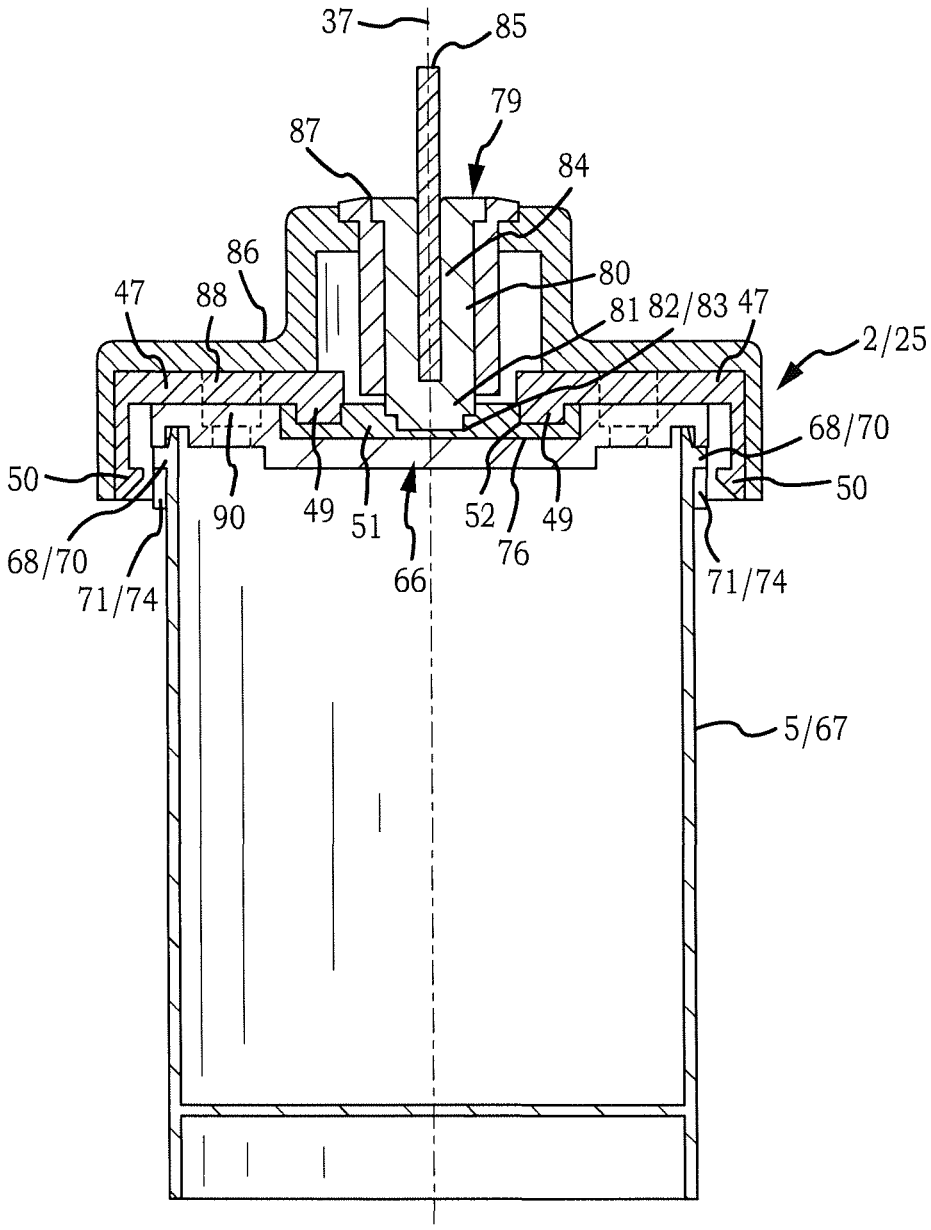
FIG. 24 is a cross section view of the embodiment of the locking cap and vessel shown in FIG. 17 having a plurality of lock arms disposed in the extended condition to allow release of the locking cap from the vessel.
Figure 25:
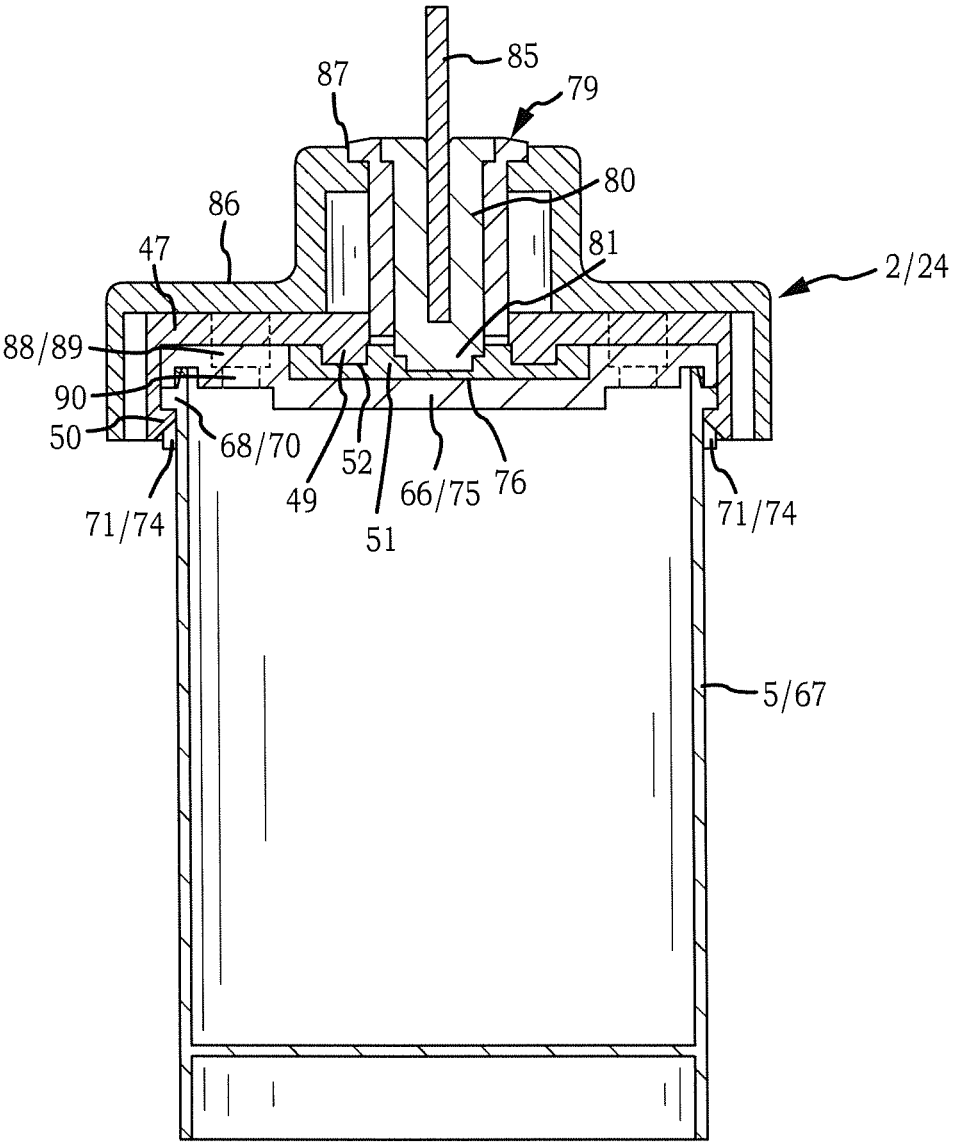
FIG. 25 is a cross section view of the embodiment of the locking cap and vessel shown in FIG. 17 having a plurality of lock arms disposed in the retracted condition to secure the locking cap to the vessel.

Now referring to FIGS. 17-25, another embodiment of a vessel locking system (1) is illustrated. The particular embodiment of the vessel locking system (1) shown provides a locking cap (2) which can lockingly engage a vessel (5). The locking cap (2) includes a plurality of lock arms (47) which extend radially outward about a central longitudinal axis (37). Each of the plurality lock arms (47) has a length (48) disposed between a cam end (49) and a latch end (50). The locking cap (2) can further include a cam (51) having a plurality of cam elements (52) spaced radially about the central longitudinal axis (37). Each one of the plurality of cam elements (52) can slidely engage a corresponding one of the cam ends (49) of a lock arm (47), whereby rotation of the plurality of cam elements (52) about the central longitudinal axis (37) in a first direction (53) acts on the corresponding plurality of lock arms (47) to radially extend the corresponding latch end (50) to achieve the open condition (25) of the locking cap (2) as shown in FIG. 24. Rotation of the plurality of cams about the central longitudinal axis (37) in a second direction (54) acts on the corresponding plurality of lock arms (47) to radially retract the corresponding latch end (50) to achieve the closed condition (24) of the locking cap (2) as shown in FIG. 25.

Figure 20:
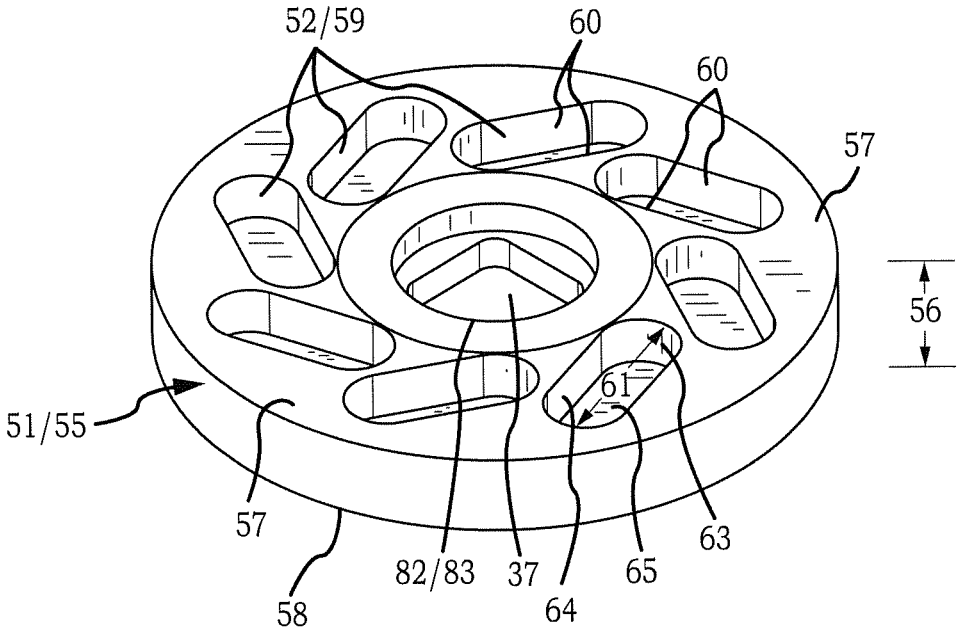
FIG. 20 is a perspective view of the particular embodiment of a cam which can be utilized in the embodiment of the locking cap shown in FIG. 17.
Figure 21:
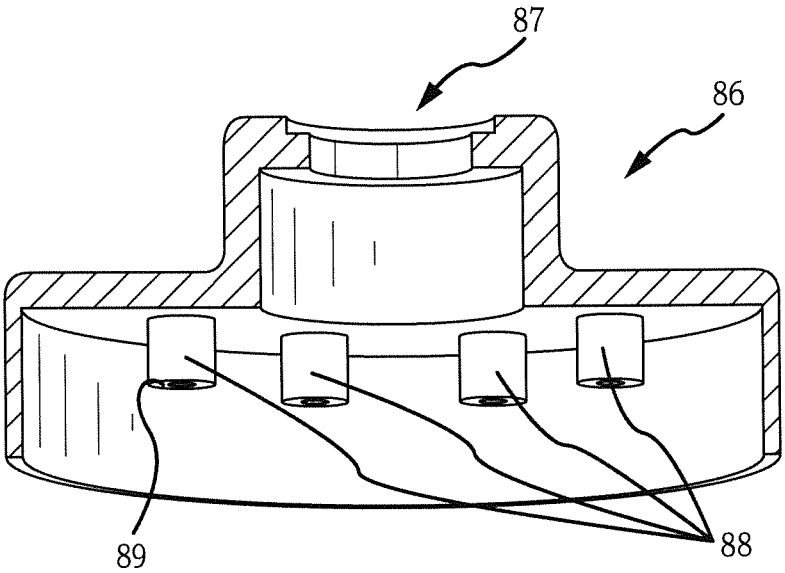
FIG. 21 is a cross section view of the particular embodiment of a cap cover which can be utilized with the embodiment of the locking cap shown in FIG. 17.

Now referring primarily to FIG. 20, a particular embodiment of the cam (51) can provide a generally circular disk (55) having a thickness (56) disposed between a cam top surface (57) and a cam bottom surface (58). Each of the plurality of cam elements (52) can be of substantially identical constructional form comprising a slot (59) in the cam (51). Each slot (59) having a pair of side walls (60) disposed in substantially parallel relation a distance apart. The distance between the pair of side walls (60) sufficient to allow the cam end (49) of a corresponding locking arm (47) to be received within the slot (59) to operate in sliding engagement with at least one of the pair of side walls (60) along the length (61) of the slot (59). The dimensional relations between the pair of side walls (60) and the cam end (49) of the locking arm (47) can be adjusted to allow a desired level of resistance or desired amount of delay in travel of the cam end (49) in response to directional travel (53)(54) of the cam element (52) about the central longitudinal axis (37). The embodiment of the cam end (49) shown in FIG. 17 has a cylindrical configuration of dimension relations which allows sliding engagement of an external cylindrical surface (62) with each of the pair of side walls (60) of the slot (50).

Each of the plurality of slots (59) disposes a first slot end (63) a lesser distance from the central axis (37) than a second slot end (64). Accordingly, as the cam end (49) travels toward the first slot end (63) the distance between the cam end (49) and the central axis (37) decreases and as the cam end (49) travels toward the second slot end (64) the distance between the cam end (49) and the central axis (37) increases. The slot (59) can be closed end (or closed bottom) (65) as show in FIG. 20 or can communicate between the cam top surface (57) and the cam bottom surface (58) depending on the embodiment. The constructional form of the plurality of cam elements (52) being slots or recesses in the cam (51) is not intended to limit the invention to this configuration of cam (51) or cam elements (52), but rather is intended to be sufficiently illustrative to allow a person of ordinary skill in the art to make and use a numerous and wide variety of cams (51) and cam elements (52) to achieve the same or substantially similar extension or retraction of the plurality of locking arms (47) in relation to the central axis (37). As but one alternate example, a hollow cam element could be mounted on each locking member and receive an upwardly projecting pin joined to the rotatable cam. Directional travel of the pin about the central axis would generate travel within the hollow cam element to extend and retract the locking arm in relation to the central axis.

Figure 17:
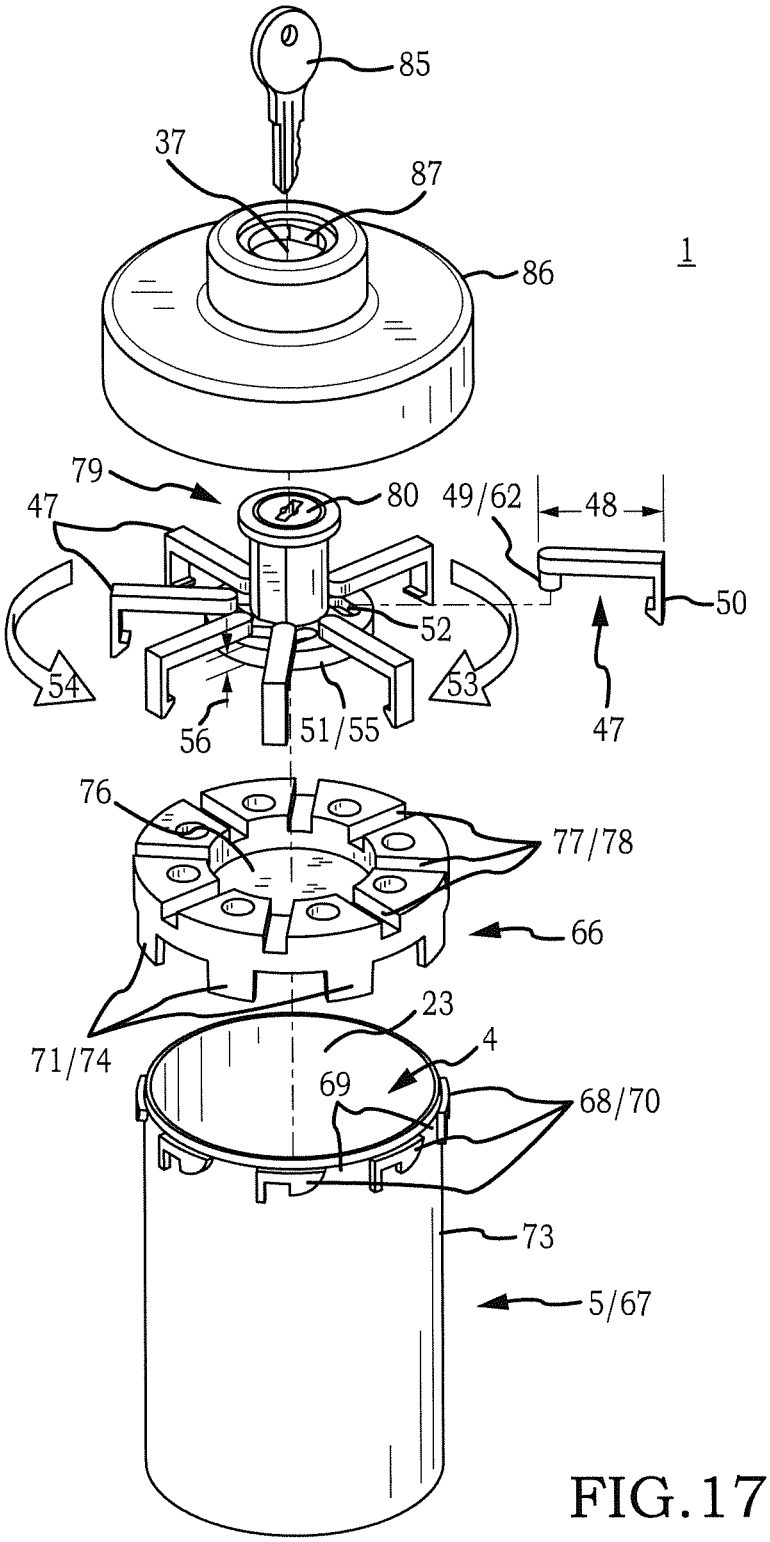
FIG. 17 is an exploded view of a vessel having a vessel inlet which can be releasably fitted a particular embodiment of the locking cap.
Figure 18:
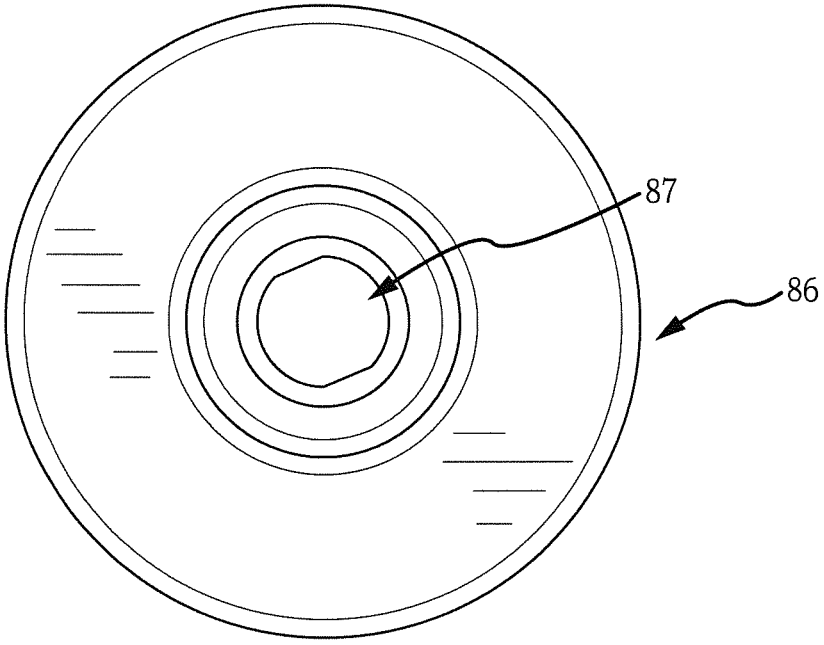
FIG. 18 is a plan view of a particular embodiment of the locking cap shown in FIG. 17.
Figure 19:
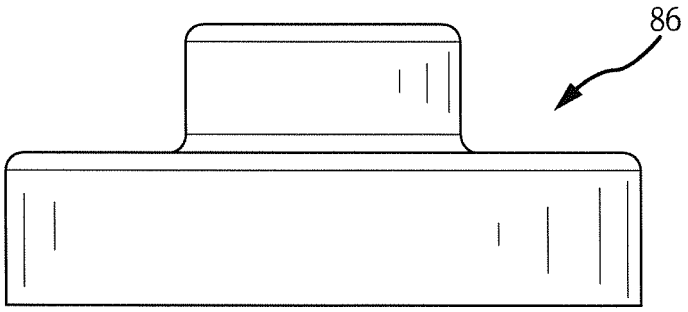
FIG. 19 is a side view of a particular embodiment of the locking cap shown in FIG. 17.

Now referring primarily to FIGS. 17 and 22 and 23, which show a particular embodiment of a cam support (66) configured to removably couple to the portion of a vessel (5) which defines the inlet (4) of the vessel (5). The cam support (66) can be coupled to the vessel (5) to support the cam (51) in relation to the inlet (4) of the vessel (5) and in rotatable operable relation to the central longitudinal axis (37) to allow each latch end (50) upon retraction of a corresponding one of the plurality of lock arms (47) to lockingly engage a portion (13) (or "vessel catch") of the vessel (5).

As shown in FIG. 17, as one non-limiting example, the vessel (5) can be one of a wide and numerous variety of configurations of conventional tamper resistant vessels (67) which have a plurality of tamper resistant catches (68) spaced periodically about the external surface of the vessel (5) proximate the inlet (4). The plurality of tamper resistant catches (68) project a distance from the external surface of the vessel (5) leaving between a corresponding plurality of recessed spaces (69). Understandably, a vessel (5) could be configured with a plurality of catches (70) spaced periodically about the surface of the vessel (5) proximate the inlet (4) leaving between recessed spaces (69) and the locking cap (2) can thereby either retrofit a variety of conventional vessels (67) or fit a variety of non-conventional vessels (5) utilizing substantially the same or similar locking elements as described and shown in the Figures.

Accordingly, the cam support (66) can include a vessel securement element (71) which releasably secures the cam support (66) to the vessel (5)(67). The vessel securement element (71) can take the form of a cam support plug (72) which inserts inside of the inlet (4) of the vessel (5) to engage a portion of the internal vessel surface (23). As shown in FIGS. 17 and 23, the vessel securement element (71) can alternately be configured to engage a portion of the external vessel surface (73) of the vessel (5) and in particular can take the constructional form of a plurality of tabs (74) which locate adjacent the external vessel surface (73) of the vessel (5) and insertingly interdigitate with the tamper resistant catches (68) of certain conventional vessels (67) or catches (70) of vessels (5) configured to receive embodiments of the locking cap (2), as above described. The plurality of tabs (74) when interdigitatedly coupled between the plurality of catches (68)(70) of the vessel (5) obviate or provide a desired level of rotation of the cam (51) in relation to the vessel (5). The plurality of tabs (74) shown in FIG. 17, essentially obviate rotation of the cam support (66) in relation to the vessel (5) upon engagement.

Now referring primarily to FIGS. 17 and 22-23, the cam support (66) further includes a support element (75) joined to the vessel securement element (71) such that engagement of the vessel securement element (71) with the vessel (5) establishes the support element (75) in fixed relation to the inlet (4) of the vessel (5) and the central longitudinal axis (37) of the locking cap (2) to allow operation of the cam (51). Typically, as shown in FIG. 17, the support element (75) has configuration which provides a cam element recess (76) (which can be circular) which insertingly receives the cam (51) (which can be correspondingly circular). The cam (51) rotates within the cam element recess (76) of the cam support (66) to correspondingly rotate the plurality of cam elements (52), as above described.

The cam support (66) can further include a plurality of locking arm guides (77) each one slidely engaging a portion of the lock arm (47) between the cam end (49) and the latch end (50) to guide radial travel of the lock member (47) between the open condition (25) and the closed condition (24) of the locking cap (2). Referring to FIG. 17, each locking arm guide (77) can take the form of a radial recess (78) communicating between the cam element recess (76) of the cam support (66) and the external surface of the vessel securement element (71). The radial recess (78) while typically of mated dimensional relations with the central portion of the locking arm (47) providing slidely engaged external surfaces; certain embodiments may allow a greater amount of distance between surfaces of the locking arm guide (77) and the locking member (47) to reduce friction or provide some lateral movement of the latch end (50) about the external circumference of the vessel (5).

Now referring primarily to FIGS. 17, 24 and 25, certain embodiments of the vessel locking system (1) can further include a lock (79) having a lock member (80) longitudinally rotatably aligned with the central longitudinal axis (37) of the locking cap (2). The lock member (80) can have a lock member end (81) configured to insertingly join the cam (51) as shown in FIG. 17. As shown in FIG. 22, the cam (51) can have a lock member recess (82) which correspondingly slidely receives the correspondingly configured external surface of the lock member end (81) such that the lock member (80) aligns with the central longitudinal axis (37) of the locking cap (2). The lock member recess (82) can in part be configured to provide any of variety of configurations such as the square recess (83) shown in FIG. 20 to achieve rotationally fixed relation between the lock member (80) and the lock member recess (81) whereby rotation of the lock member (80) correspondingly rotates the cam (51) about the central longitudinal axis (37). Again referring to primarily to FIG. 17, the lock (79) can further provide a lock assembly (84) which allows rotation of the lock member (80) upon insertion of a key (85).

Now referring primarily to FIGS. 17, 18, 19, 21, 24 and 25, the locking cap (2) can further include a cap cover (86) which couples to said cam support (66). The cap cover (86) can be configured to house the lock (79), the plurality of lock arms (47), the cam (51) and the cam support (66) while further including a lock aperture (87) through which the key (85) can insertingly engage the lock assembly (84). As shown in FIGS. 24 and 25 the cap cover (86) can provide a plurality of cap cover pegs (88) each having a peg end (89) corresponding received within peg hole (90) disposed in the cam support (66). The plurality of pegs (88) engaged in the corresponding plurality of peg holes (90) fixes the cap cover (86) in fixed relation to the cam support (66).

Now referring primarily to FIG. 24, the locking cap (2) can by keyed rotation of the lock member (80) establish the plurality of lock arms (47) in the open condition (25)(extended). The locking cap (2) can in the open condition (25) allow the vessel securement element (71) to engage the vessel (5)(67) thereby locating the plurality of latch ends (50) for engagement with the catches (68)(70) disposed about the external surface of the vessel (5)(67).

Now referring primarily to FIG. 25, the locking cap (2) can by keyed rotation of the lock member (80) establish the plurality of lock arms (47) in the closed condition (24)(retracted). The locking cap (2) in the closed condition (24) secures the locking cap (2) in fixed relation to the vessel (5)(67).

As can be easily understood from the foregoing, the basic concepts of the present invention may be embodied in a variety of ways. The invention involves numerous and varied embodiments of a vessel locking system and methods of using a vessel locking system including the best modes, as above described.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

It should be understood that each element of an apparatus or each step of a method may be described by an apparatus term or method term. Such terms can be substituted where desired to make explicit the implicitly broad coverage to which this invention is entitled. As but one example, it should be understood that all steps of a method may be disclosed as an action, a means for taking that action, or as an element which causes that action. Similarly, each element of an apparatus may be disclosed as the physical element or the action which that physical element facilitates. As but one example, the disclosure of a "lock" should be understood to encompass disclosure of the act of "locking"—whether explicitly discussed or not—and, conversely, were there effectively disclosure of the act of "locking", such a disclosure should be understood to encompass disclosure of a "lock" and even a "means for locking." Such alternative terms for each element or step are to be understood to be explicitly included in the description.

"A" or "an" entity refers to one or more of that entity; for example, "a vessel" refers to one or more of those vessels or at least one vessel. As such, the terms "a" or "an", "one or more" and "at least one" can be used interchangeably herein. Furthermore, the language "selected from the group consisting of" refers to one or more of the elements in the list that follows, including combinations of two or more of the elements.

"About" for the purposes of the present invention means that ranges may be expressed as from "about" one particular value to "about" another particular value. When such a range is expressed, another embodiment includes from the one particular value to the other particular value. Similarly, when values are expressed as approximations, by use of the antecedent "about," it will be understood that the particular value forms another embodiment. In the context of such a numerical value or range "about" means plus or minus 10% of the numerical value or range recited or claimed.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the vessels and vessel locking systems herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

The background section of this patent application provides a statement of the field of endeavor to which the invention pertains. This section may also incorporate or contain paraphrasing of certain United States patents, patent applications, publications, or subject matter of the claimed invention useful in relating information, problems, or concerns about the state of technology to which the invention is drawn toward. It is not intended that any United States patent, patent application, publication, statement or other information cited or incorporated herein be interpreted, construed or deemed to be admitted as prior art with respect to the invention.

The claims set forth in this specification, if any, are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent application or continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

The claims set forth below, if any, are intended to describe the metes and bounds of a limited number of the preferred embodiments of the invention and are not to be construed as the broadest embodiment of the invention or a complete listing of embodiments of the invention that may be claimed. The applicant does not waive any right to develop further claims based upon the description set forth above as a part of any continuation, division, or continuation-in-part, or similar application.

I claim:

1. A releasable locking cap, comprising:

a) a plug having a thickness disposed between a top surface and a bottom surface and bounded by a side surface, said side surface configured to allow removable insertion in an inlet of a vessel;

b) at least one lock member bore which extends a distance inwardly from said side surface;

c) at least one lock member slidably engaged within said at least one lock member bore having a length disposed between a first end and a second end;

d) at least one lock member magnet directly connected to said at least one lock member;

e) a magnetic field which repulses said at least one lock member magnet to generate travel of said at least one lock member within said at least one lock member bore to extend said first end of said at least one lock member beyond said side surface to allow lockable engagement of said first end with a portion of said vessel.

2. The releasable locking cap of claim 1, further comprising a cap key configured to locate at least one cap key magnet in relation to said at least one lock member magnet directly connected to said at least one lock member to generate sufficient travel of said at least one lock member within said at least one lock member bore to disengage said first end from said portion of said vessel.

3. The releasable locking cap of claim 2, wherein said at least one lock member magnet directly connects to said second end of said at least one lock member and wherein said cap key has a configuration which engages said plug to locate said at least one cap key magnet proximate said second end of said at least one lock member.

4. The releasable locking cap of claim 2, wherein said at least one lock member magnet directly connects to said second end of said at least one lock member and wherein said cap key has a configuration which engages said plug to locate said at least one cap key magnet proximate said first end of said at least one lock member.

5. The releasable locking cap of claim 2, wherein said at least one lock member comprises a plurality of lock members each having a length disposed between said first end and said second end, and wherein said at least one lock member magnet comprises a plurality of lock member magnets one each correspondingly directly connected to said second end of each of said plurality of lock members.

6. The releasable locking cap of claim 5, wherein said at least one lock member bore comprises a plurality of lock member bores, and wherein one of said plurality of lock members slidably engages a corresponding one of said plurality of lock bores, and wherein said plurality of lock member bores disposed within said plug disposes each of said plurality of lock member magnets at a location which generates said magnetic field which repulses said plurality of lock members to extend each said first end of said plurality of lock members beyond said side surface to allow lockable engagement of each said first end with a portion of said vessel.

7. The releasable locking cap of claim 6, wherein said cap key has a configuration which engages said plug to locate each one of a plurality of cap key magnets in sufficient proximity to a corresponding one of said plurality of lock member magnets to generate travel of each one of said plurality of lock members within each of said plurality of lock member bores to disengage each said first end from said portion of said vessel.

8. The releasable locking cap of claim 7, wherein said cap key locates each of said plurality of cap key magnets proximate a corresponding second end of said plurality of lock members.

9. The releasable locking cap of claim 7, wherein said cap key locates each of said plurality of cap key magnets proximate a corresponding first end of said plurality of lock members.

10. The releasable locking cap of claim 2, further comprising a cap key guide coupled to said plug, said cap key guide configured to guide a portion of said cap key to engage said plug to locate said at least one cap key magnet coupled to said cap key in sufficient proximity to said at least one lock member magnet coupled to said second end of said at least one lock member to disengage said first end from said portion of said vessel.

11. The releasable locking cap of claim 7, further comprising a cap key guide coupled to said plug, said cap key guide configured to guide a portion of said cap key to engage said plug to locate each of said plurality of cap key magnets in sufficient proximity to a corresponding one of said plurality of lock member magnets to disengage each said first end from said portion of said vessel.

12. The releasable locking cap of claim 10, wherein said cap key guide has an external surface configured to engage a cap key aperture which aligns said at least one cap key magnet proximate said first end of said lock member.

13. The releasable locking cap of claim 11, wherein said cap key guide has an external surface configured to engage a cap key aperture which aligns each one of said plurality of cap key magnets proximate a corresponding one said first end of said plurality of lock members.

14. The releasable locking cap of claim 11, wherein said cap key guide further comprises a key guide inlet which insertingly receives a portion of said cap key, said key guide inlet configured to guide a portion of said cap key to engage said plug to locate each of said plurality of cap key magnets proximate a corresponding one of said plurality of lock member magnets to disengage each said first end from said portion of said vessel.

15. The releasable locking cap of claim 14, wherein said key guide inlet has a closed end located a depth within said plug sufficient to allow said plurality of lock member bores to communicate between said side surface of said plug and an internal surface of said key guide inlet.

16. The releasable locking cap of claim 1, further comprising a cap body coupled to said plug, wherein said cap body has configuration of sufficiently greater dimension than said plug to prevent said cap body from being inserted within said inlet of said vessel.

17. The releasable locking cap of claim 1, wherein said side surface of said plug has a configuration selected from the group consisting of: circular, square, rectangular, oval, and triangular.

18. The releasable locking cap of claim 1, wherein said at least one lock member has a cross sectional area selected from the group consisting of: circular, square, rectangular, oval, and triangular.

* * * * *